US007671300B2

(12) United States Patent
Lucas et al.

(10) Patent No.: US 7,671,300 B2
(45) Date of Patent: Mar. 2, 2010

(54) FUSER ASSEMBLY HAVING HEATER ELEMENT WITH SPACED-APART FEATURES

(75) Inventors: Russell Edward Lucas, Lexington, KY (US); Jason Romain, Versailles, KY (US); Jerry Wayne Smith, Irvine, KY (US); Casey Thomas Wilson, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 160 days.

(21) Appl. No.: 11/468,516

(22) Filed: Aug. 30, 2006

(65) Prior Publication Data

US 2008/0083746 A1 Apr. 10, 2008

(51) Int. Cl.
*H05B 3/00* (2006.01)
*G03G 21/00* (2006.01)

(52) U.S. Cl. ..... 219/216; 219/469; 219/470; 219/471; 219/549; 399/333; 399/320; 399/324; 399/325; 399/328; 399/329; 399/330; 399/331; 428/421; 428/422; 428/423.1; 428/447; 432/59

(58) Field of Classification Search ..... 219/216, 219/469–471; 399/333, 320, 324–5, 328–31; 428/421–422, 423.1, 447; 432/59
See application file for complete search history.

(56) References Cited

U.S. PATENT DOCUMENTS

| | | | | |
|---|---|---|---|---|
| 6,090,305 | A | 7/2000 | Balch et al. | |
| 6,689,528 | B2 | 2/2004 | Ream et al. | |
| 6,818,290 | B1 | 11/2004 | Chopra et al. | |
| 6,879,803 | B2 * | 4/2005 | Gogate et al. | 399/329 |
| 7,005,611 | B2 | 2/2006 | Hamilton et al. | |
| 2004/0035843 | A1 | 2/2004 | Hamilton et al. | |
| 2006/0067751 | A1 | 3/2006 | Gilmore | |
| 2006/0067754 | A1 | 3/2006 | Gilmore et al. | |
| 2006/0133867 | A1 | 6/2006 | Coleman et al. | |

* cited by examiner

*Primary Examiner*—Shawntina Fuqua

(57) ABSTRACT

A heater element is provided adapted to heat a belt in a fuser assembly. The heater element comprises laterally spaced-apart features extending beyond a center section provided between the features. The features and center section are adapted to face an inner surface of the belt.

13 Claims, 7 Drawing Sheets

FUSER ASSEMBLY HAVING HEATER ELEMENT WITH SPACED-APART FEATURES

TECHNICAL FIELD AND INDUSTRIAL APPLICABILITY OF THE INVENTION

The present invention relates to a fuser assembly including structure to reduce wrinkling in substrates passing through the fuser assembly.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to media, such as a paper substrate, intended to receive the final permanent image. The toner image is fixed to the media by the application of heat and pressure in a fuser assembly. A fuser assembly may include a heated roller and a backup roller forming a fusing nip through which the media passes. A fuser assembly may also include a fuser belt and an opposing backup member, such as a backup roller. Processing of substrates such as sheets of paper through the fusing nip compresses and flattens the sheet just before or as the image is being fixed onto the surface of the sheet.

Paper substrates are usually packaged in reams of 500 sheets enclosed in a protective, often waterproof wrapper. Since paper is somewhat hygroscopic, paper substrates may absorb moisture when exposed to ambient air. Depending on storage conditions for the paper substrates, once the protective packaging has been opened the paper may absorb moisture from the surrounding air causing the fibers of the paper to swell and lengthen. This may result in a change in the dimensions of the paper substrates depending on whether the moisture is absorbed uniformly or non-uniformly across the length and width of each substrate. Such moisture absorption may lead to wavy edges being formed.

FIG. 1 illustrates a paper substrate 1 which has been exposed to a high level of ambient humidity on one end or edge 2, such as where a protective packaging for a ream from which the substrate 1 was taken has been opened only at one end. Thus, moisture was absorbed at the one exposed edge 2 creating a moisture gradient from the exposed edge 2 to a drier protected opposite edge 5 which was covered by the packaging. The moisture gradient caused the exposed edge 2 to lengthen in the width-wise direction, due to the swelling of the paper fibers. However, the substrate edge 2 is constrained by the dimension of a dry portion 3 of the substrate 1 such that a boundary condition is essentially set up that will not allow the lengthened or widened edge 2 of the sheet to be substantially wider than the dry portion 3. Hence, the edge 2 becomes wavy or buckles due to this constraint and remains essentially the same effective horizontal width as the remainder of the substrate 1. In other words, for an 8.5"×11" size substrate of paper, the distance between corners 4 and 4' remains about 8.5".

If the substrate 1 is fed with the wavy edge 2 first through a conventional fusing nip 6, which may be defined by a pair of fusing rollers, the edge 2 may be pressed out by the compressive forces applied by the nip 6, making the edge 2 flat, see FIG. 2. The edge 2 is now wider than the width of the dry portion 3, resulting in non-parallel outer edges 2A and 3A on each side of the substrate 1. Due to stress reactions in the non-parallel outer edges 2A and 3A of the substrate 1, corrugations 8 are formed in the substrate 1, see FIG. 3. The corrugations 8 are formed into wrinkles 8A as the substrate 1 passes through the nip 6. The wrinkles 8A cause defective copies and customer complaints.

U.S. Patent Application Publication No. US 2006/0133867 A1, the entire disclosure of which is incorporated herein by reference, provides one solution to this problem. Other solutions for reducing wrinkling in paper substrates having one or more wavy edges are desirable.

SUMMARY OF THE INVENTION

In accordance with a first aspect of the present invention, a heater element is provided adapted to heat a belt in a fuser assembly. The heater element comprises laterally spaced-apart features extending outwardly beyond a center section provided between the features. The features and center section are adapted to face an inner surface of the belt.

The features may be positioned near a substrate input edge of the heater element.

The heater element may further comprise: a substrate having first and second outer surfaces; material provided on the substrate first outer surface; and one or more glass layers provided over the material and at least one section of the substrate first outer surface not including the material. A first portion of the material provided on the substrate first outer surface may define elements capable of generating heat.

A portion of each of the one or more glass layers may define a portion of each of the features.

The material may further comprise second portions provided on the substrate first outer surface for defining portions of the features.

One or more additional layers of material may be provided only in areas corresponding to the features for defining portions of the features.

An outermost glass layer may define an outer surface of the heater element adapted to engage the inner surface of the belt. A portion of the outermost glass layer may define a layer of the center section provided between the features.

In accordance with a second aspect of the present invention, an apparatus is provided for fixing a toner image on a substrate. The apparatus comprises a heater assembly; a flexible belt; and a driven backup member. The heater assembly may comprise a housing and a heater element mounted in the housing. The flexible belt may be positioned about the heater assembly and include an inner surface engageable with the heater element so as to receive energy in the form of heat generated by the heater element. The driven backup member may be positioned in opposition to the heater assembly. The flexible belt may extend between the heater assembly and the driven backup member such that a fusing nip for receiving a substrate is defined between the backup member and the flexible belt at a location where the belt passes below a center portion of the heater element. The heater element may comprise laterally spaced-apart features extending above a center section provided between the features. The features and center section face the belt inner surface. The backup member and the belt at locations where the belt passes the features engage laterally spaced apart outer edge portions of the substrate prior to the substrate entering the nip so as to prevent the substrate from expanding in width as it passes through the fusing nip.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 4:
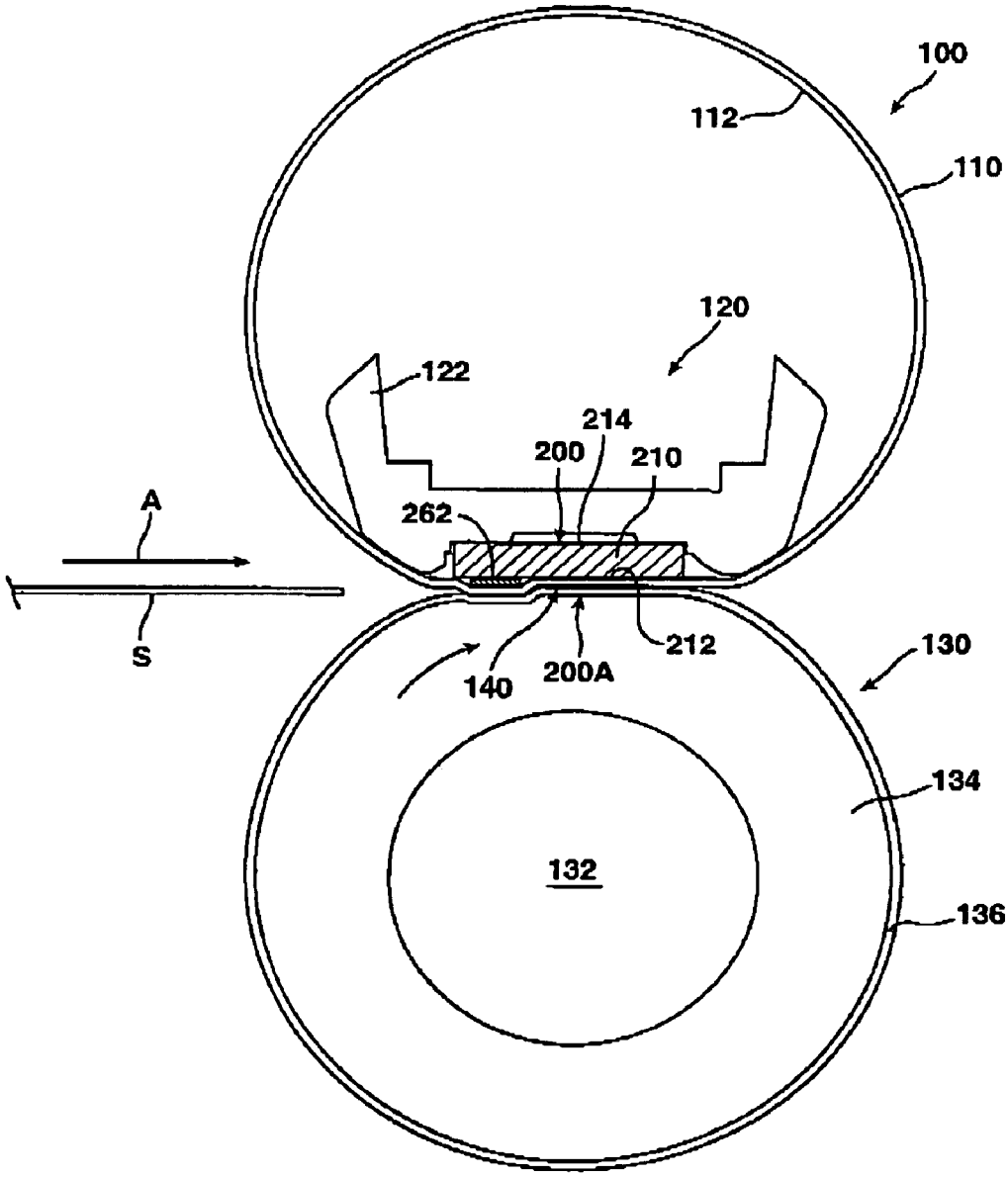
FIG. 4 is a side view of a fuser assembly constructed in accordance with the present invention.

A fuser assembly 100 formed in accordance with the present invention is illustrated in FIG. 4. The fuser assembly 100 comprises a flexible endless belt 110, a heater assembly 120 and a backup member in the form of a roller 130. In the illustrated embodiment, the backup roller 130 is driven and the fuser belt 110 is an idler belt. However, the drive scheme may be reversed. The fuser belt 110 and the backup roller 130 define a fusing nip 140 therebetween for receiving a substrate S with toner thereon.

The endless belt 110 may comprise an inner base layer comprising polyimide with a thermally conductive filler, a first primer layer adjacent the polyimide layer with an electrically conductive filler, and an outer release layer having an electrically semiconductive filler. An example belt 110 is disclosed in U.S. Pat. No. 6,689,528, the disclosure of which is incorporated herein by reference.

The heater assembly 120 may comprise a high temperature housing 122 formed from a polymeric material such as a liquid crystal polymer. A heater element 200 is fixed to the housing 122 such as by a thermally cured silicone adhesive. The flexible belt 110 may be positioned about the heater assembly 120. The belt 110 includes an inner surface 112 engageable with the heater element 200 so as to receive energy in the form of heat generated by the heater element 200. The heater element 200 will be discussed in detail below.

The backup roller 130 may comprise an inner core 132, an inner polymeric layer 134 and an outer toner release layer or sleeve 136. The inner core 132 may be formed from a polymeric material, steel, aluminum or a like material. The inner polymeric layer 134 may be formed from a silicone foam or rubber material. The outer release layer 136 may comprise a sleeve formed from PFA (polyperfluoroalkoxy-tetrafluoroethylene) or other fluororesin material. The outer release layer 136 may also be formed via a latex and or PFA spray coating. A conventional drive mechanism (not shown) is provided for effecting rotation of the backup roller 130.

A substrate transport device (not shown), such as a belt, may be provided to feed substrates S one a time into the fusing nip 140 in the direction of arrow A, see FIG. 4. A toner image is provided on each substrate S via one or more imaging stations, such as disclosed in U.S. Patent Application Publication 2006/0067754 A1, the disclosure of which is incorporated herein by reference. The toner image is fused to the substrate S by the belt 110, the heater element 200 and the backup roller 130 applying heat and pressure to the substrate/toner image. In the illustrated embodiment, rotation of the backup roller 130 effects movement of a substrate S through the fusing nip 140. Movement of the backup roller 130 and substrate S causes the fuser belt 110 to move relative to the heater element 200.

Figure 5:
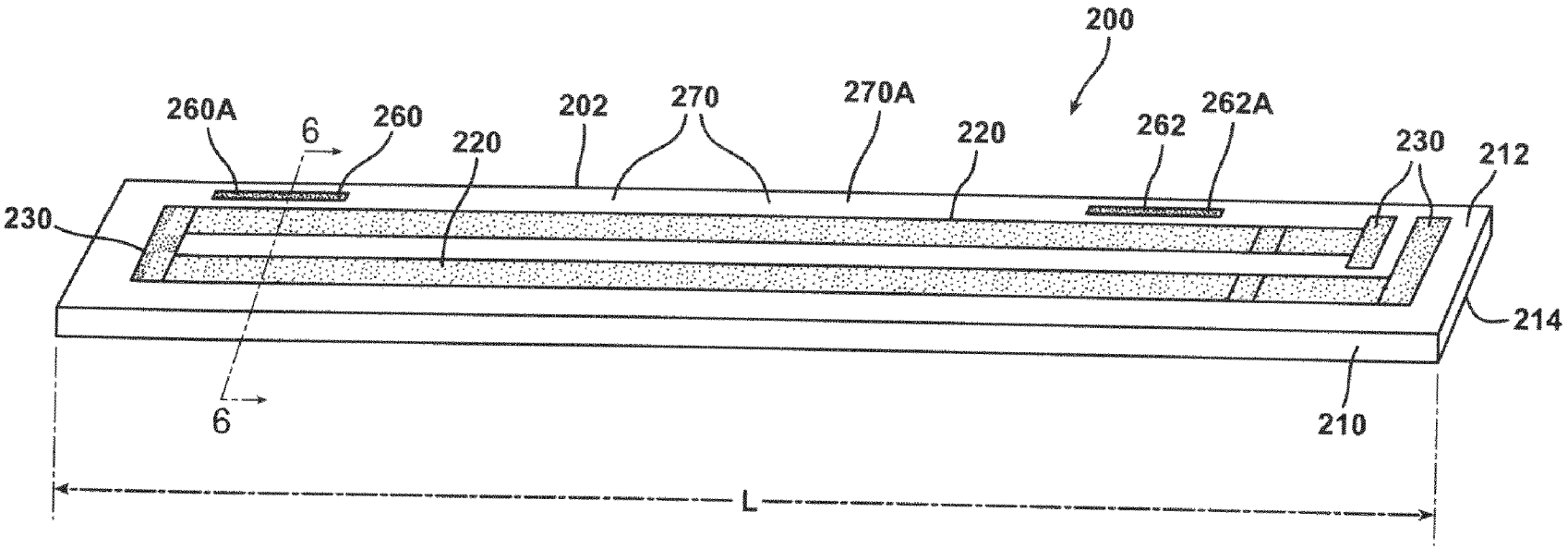
FIG. 5 is a perspective view of a heater element constructed in accordance with the present invention.
Figure 6:
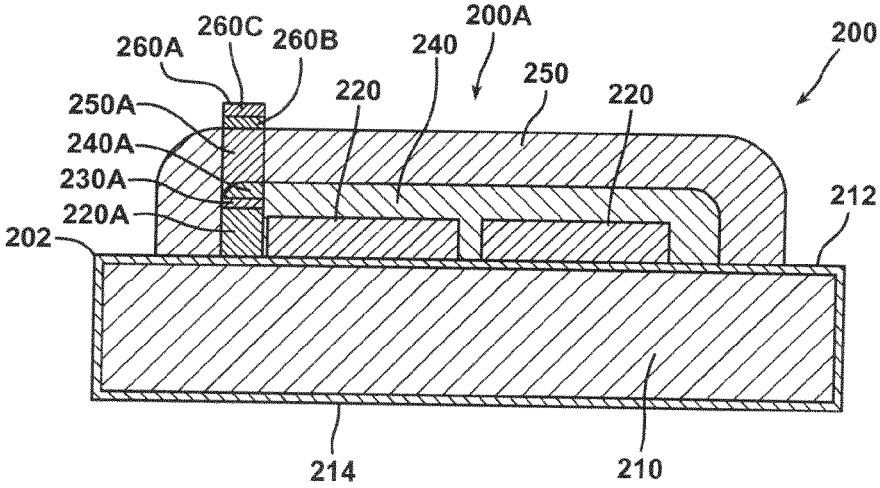
FIG. 6 is a view taken along section line 6-6 in FIG. 5.

In the illustrated embodiment, the heater element 200 comprises a ceramic substrate 210 having first and second outer surfaces 212 and 214, see FIGS. 4-6. The substrate 210 has a length L, see FIG. 5, that extends substantially perpendicular to a belt moving and a substrate feeding direction. The ceramic substrate 210 may be formed from 96% alumina, such as disclosed in U.S. Pat. No. 7,005,611, the entire disclosure of which is incorporated herein by reference, aluminum nitride or the like.

Formed on the first outer surface 212 of the substrate 210 are a plurality of resistors 220 capable of generating heat when provided with electrical power. The resistors 220 may extend along substantially the entire length L of the substrate 210, see FIG. 5. The resistors 220 may be formed on the substrate first outer surface 212 via a conventional thick film printing process using a material such as a silver palladium paste.

Also formed on the ceramic substrate first outer surface 212 are a plurality of conductors 230, see FIG. 5. The conductors 230 overlap or engage the resistors 220 and provide paths for electrical energy to travel to the resistors 220 from a power supply (not shown). The conductors 230 may be formed via a conventional thick film printing process using a material such as a silver palladium paste or a silver platinum paste.

The heater element 200 in the illustrated embodiment further comprises a glass dielectric layer 240, which functions to electrically insulate the heater element outer surface. The dielectric layer 240 is formed over the resistors 220 and conductors 230. Further, the dielectric layer 240 is formed via a conventional thick film printing process using an insulation glass material such as one commercially available from Asahi Glass Company under the product designation AP5707. While only a single dielectric layer 240 is shown in the illustrated embodiment, a plurality of such layers may be provided on the heater element 200.

A glass overglaze layer 250 is formed over the dielectric layer 240. The glass overglaze layer 250 may be formed via a conventional thick film printing process using a cover glass material such as one commercially available from Asahi Glass Company under the product designation AP5349. While only a single overglaze layer 250 is shown in the illustrated embodiment, a plurality of such layers may be provided on the heater element 200.

It is contemplated that the dielectric layer 240 may be replaced by another glass overglaze layer 250.

It is also contemplated that other conductors (not shown) may be formed on the ceramic substrate second outer surface 214. A thermistor chip (not shown) may be attached to the substrate second outer surface 214.

Figure 6A:
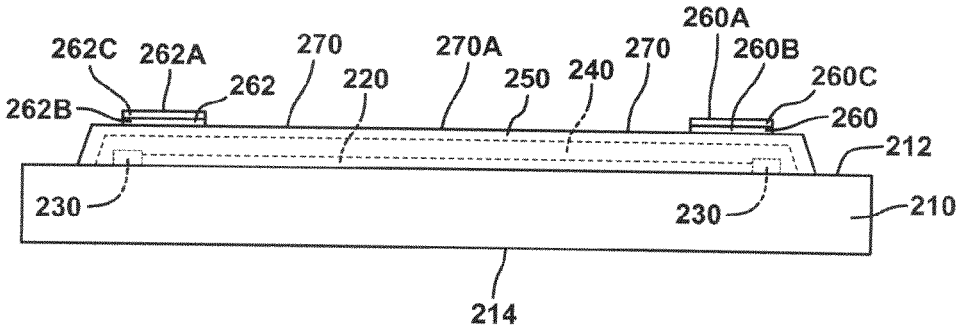
FIG. 6A is a side view of the heater element illustrated in FIG. 5.

In the illustrated embodiment, a pair of laterally spaced-apart features 260 and 262 are provided on the heater element 200. The features 260 and 262 are formed over the substrate first outer surface 212 and extend out beyond a center section 270 of the heater element 200 located between the features 260 and 262, see FIGS. 6A, 7A and 7B. Hence, the outermost surface 260A, 262A of each feature 260, 262 is spaced a further distance away from the substrate first outer surface 212 than an outer surface 270A of the center section 270, see FIG. 6A.

At least a portion of the features 260 and 262 may be formed on the substrate first outer surface 212 during the same process operations and from the same materials used to form the resistors 220, conductors 230, glass dielectric layer 240 and glass overglaze layer 250. For example, when resistor material is applied to the substrate first outer surface 212 to form the resistors 220, additional resistor material 220A may be applied to the substrate first outer surface 212 in areas on the surface 212 where the features 260 and 262 are to be formed, i.e., near a substrate input edge 202 of the heater element, see FIGS. 5, 6, 7A and 7B. When conductor material is applied to the substrate first outer surface 212 to form the conductors 230, additional conductor material 230A may be applied over the resistor material 220A in the areas where the features 260 and 262 are being formed so as to form second layers defining further portions of the features 260, 262. Thereafter, when the glass dielectric layer 240 is formed, additional glass dielectric material 240A used to form the layer 240 may be provided over the conductor material 230A in the areas where the features 260 and 262 are being formed so as to form third layers of the features 260, 262. In a similar manner, when the glass overglaze layer 250 is formed, additional glass overglaze material 250A used to the form the layer 250 may be provided over the glass dielectric material 240A in the areas where the features 260, 262 are being formed so as to form fourth layers of the features 260, 262. Hence, portions of the features 260, 262 may be formed from layers of the same materials used to form the conductors 220, the resistors 230, and the glass layers 240, 250.

It is also contemplated that layers of additional material, such as one or more cover glass layers or printable polyimide layers, may be formed only in the areas where the features 260, 262 are being formed so as to provide additional material layers defining further portions of the features 260, 262. In the embodiment illustrated in FIGS. 5 and 6, further layers of materials 260B, 260C and 262B, 262C, are applied over the glass layer 250 only in the areas of the features 260, 262 to cause the features 260, 262 to extend above the surface of the glass layer 250, i.e., to extend above the center section 270. The layers 260B, 262B may be formed over the layer 250 and from a cover glass material commercially available from Asahi Glass Company under the product designation AP5700 and the layers 260C, 262C may be formed over the layers 260B, 262B and from a cover glass commercially available from Asahi Glass Company under the product designation AP5349.

It is also contemplated that the features 260, 262 may be formed without using material corresponding to one or more of the resistors 220, conductors 230, and the glass layers 240, 250.

The heater element 200 is coupled to the housing 122 such that the substrate first outer surface 212 faces toward the inner surface 112 of the belt 110, see FIG. 4. During operation of the fuser assembly 100, the first and second features 260 and 262 engage the belt inner surface 112.

Figure 1:
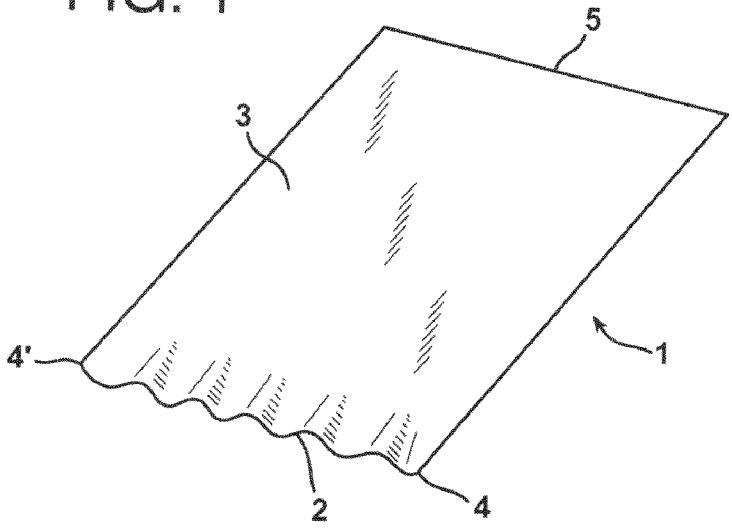
FIG. 1 is a perspective view of a substrate which has been exposed to a high level of ambient humidity on one end or edge causing the edge to become wavy.
Figure 2:
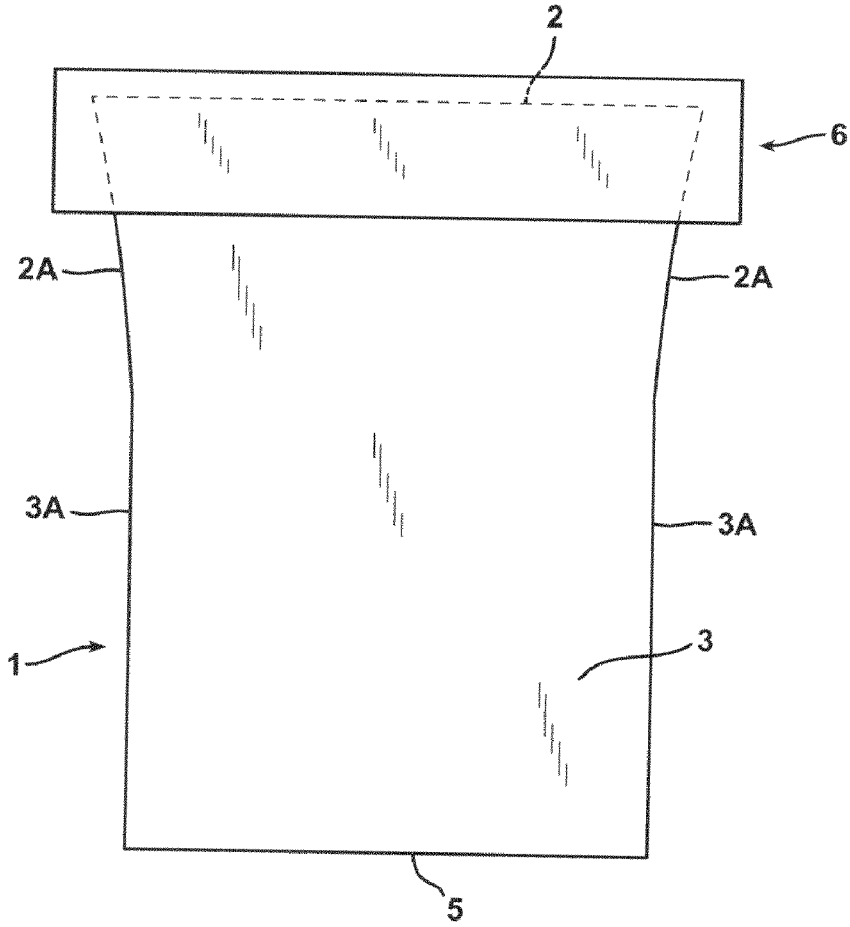
FIG. 2 PRIOR ART
FIGS. 2 and 3 illustrate the substrate in FIG. 1 passing through a conventional fusing nip.
Figure 3:
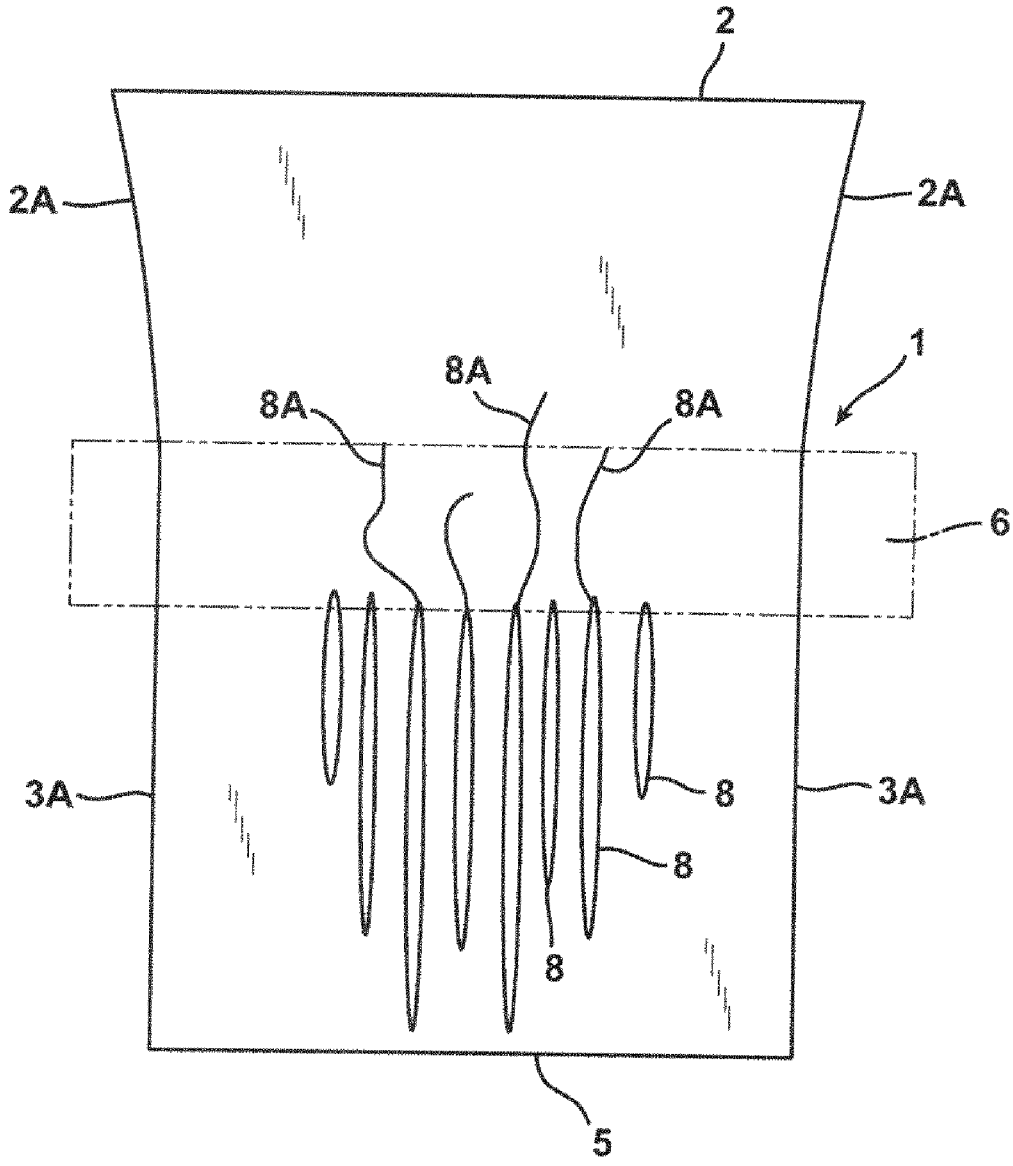
FIG. 3 PRIOR ART
Figure 7A:
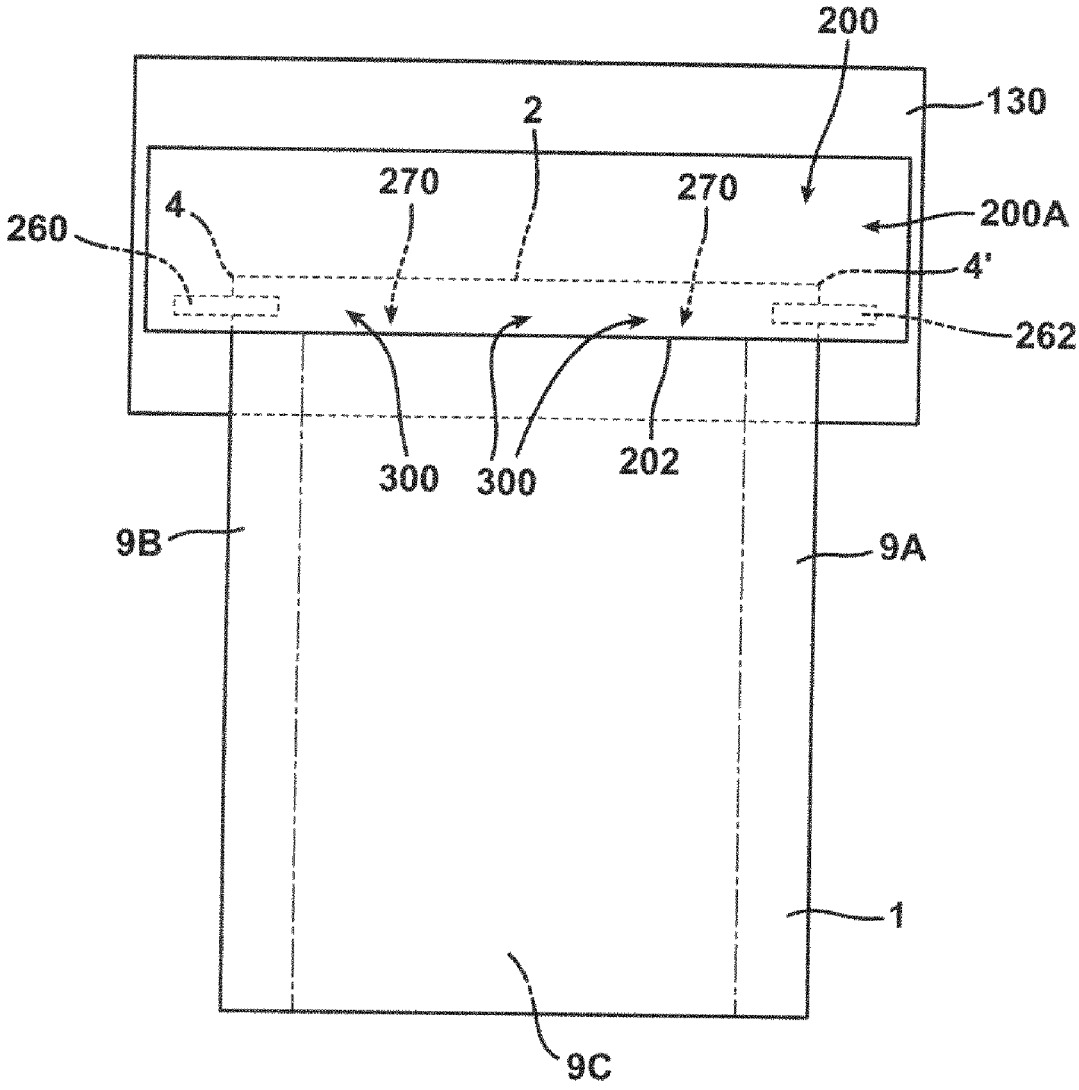
FIGS. 7A and 7B illustrate a substrate, such as the one shown in FIG. 1, passing between the heater element and backup roller illustrated in FIG. 4 and wherein the belt has been removed.
Figure 7B:
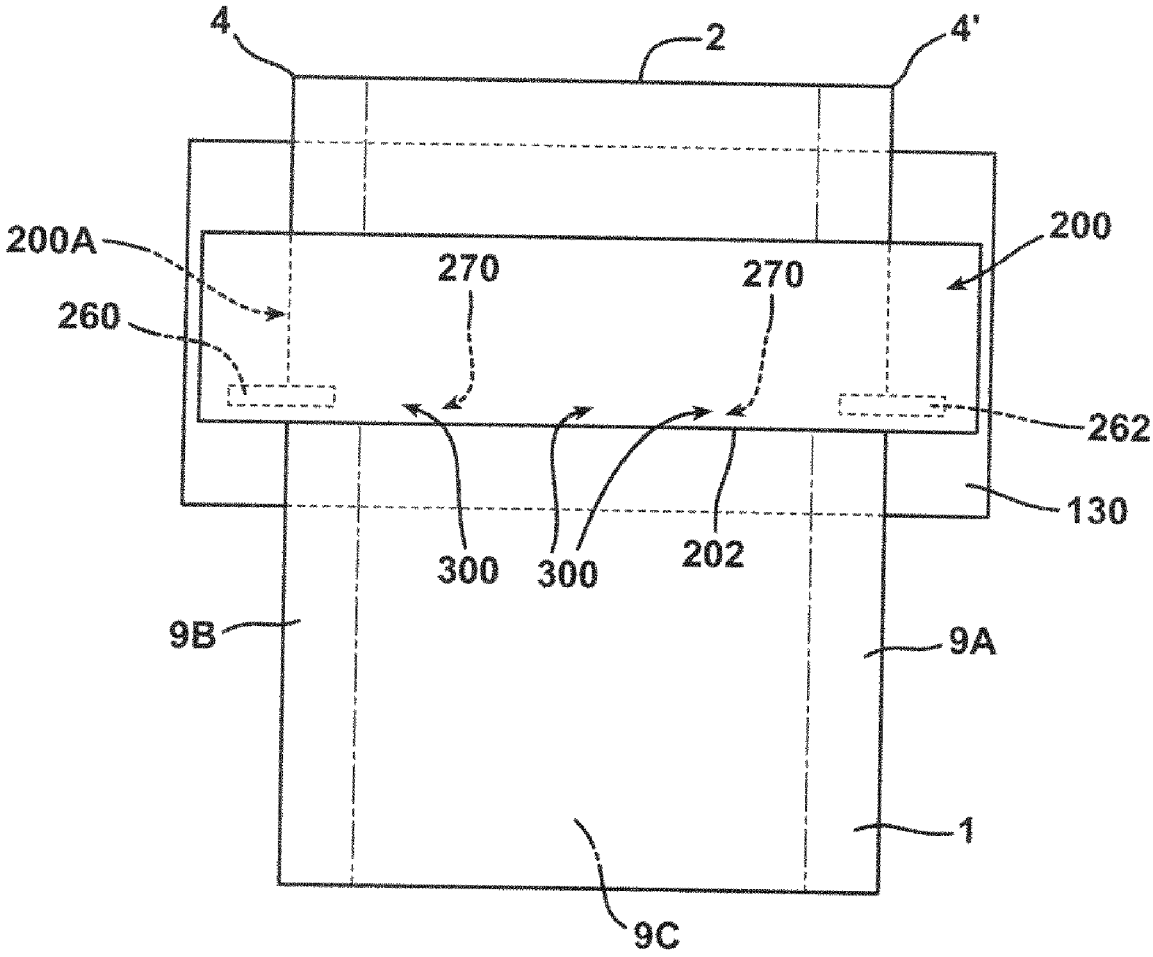

A substrate 1 having a wavy leading edge 2, as illustrated in FIG. 1, is shown in FIGS. 7A and 7B passing into and through the fusing nip 140 of the fuser assembly 100. The size, i.e., diameter, of the backup roller 130 and the height of the features 260, 262 relative to the center section 270 are selected so that the backup roller 130 and the belt 110, at locations where the belt 110 passes beneath the features 260, 262, engage only laterally spaced-apart outer edge portions 9A, 9B of the substrate 1. Thus, a center portion 9C of the substrate 1, when positioned between the belt 110 and the backup roller 130 in an area 300 between the features 260, 262, is not compressed or gripped by the belt 110 and the backup roller 130, see FIGS. 7A and 7B.

The features 260 and 262 function to create laterally spaced-apart low-pressure contact areas between the belt 110 and the backup roller 130 in front of, i.e., before, the fusing nip 140. Hence, the outer edge portions 9A, 9B of the substrate are gripped by the belt 110 and the backup roller 130 just prior to the fusing nip 140 while the center portion 9C of the substrate 1 is not gripped by the belt 110 and the backup roller 130 in the area 300 between the features 260, 262. When the wavy leading edge 2 of the substrate enters into the fusing nip 140, because the belt 110 and the backup roller 130 function to grip the substrate at its outer edge portions 9A, 9B at locations spaced a small distance from the fusing nip 140, the wavy leading edge 2 is constrained in a width-wise direction, i.e., between the corners 4 and 4', while passing through the nip 140 such that the leading edge 2 is not allowed to flatten out and expand. This, in turn, prevents corrugations from being formed in the center portion 3 and a trailing edge 5 of the substrate 1 that lead to wrinkle formation. Hence, wrinkle formation is prevented due to the use of features 260, 262 on the heater element 200.

When in the fusing nip 140, the entire width of the substrate 2 is engaged and compressed by the belt 110 and the backup roller 130, including the center portion 3 of the substrate 1. The fusing nip 140 is defined between the backup roller 130 and the flexible belt 110 at a location where the belt 110 passes below a center portion 200A of the heater element 200, see FIGS. 4, 7A and 7B.

It is advantageous to locate the features 260, 262 on the heater element 200 instead of on another element within the fuser assembly 100. If the raised features are provided on another element and the other element is spaced from the heater element 200 and not heated, the other element may act as a heat sink conducting energy in the form of heat away from the belt 110 as the belt 110 moves across that element. Also, depending upon the material from which the other element is formed, it may abrade or otherwise damage the belt 110 during movement of the belt 110 across the other element. Further, because the features 260, 262 are positioned near the fusing nip 140, the velocities of laterally spaced-apart outer edges of the belt 110 within the fusing nip 140 are more likely to be substantially the same as the velocity of a center portion of the belt 110 as compared to a fuser assembly where the features are spaced further away from the fusing nip 140.

It is contemplated that the features may be spaced from the resistors 220 and conductors 230 and the glass layers 240, 250 formed over the resistors 220 and conductors 230. Those features may be formed on the substrate first outer surface 212 via one or more of the same materials used to form the resistors 220, conductors 230, glass dielectric layer 240 and glass overglaze layer 250. It is also contemplated that separate rods or rectangular elements formed from glass or a like material may be secured to the ceramic substrate first outer surface 212 so as to define laterally spaced apart features on the heater element.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A heater element adapted to heat a belt in a fuser assembly comprising:

a first and second outer surface disposed on a substrate;

the first outer surface having plurality of resistors extending along the length of the substrate; an electrical conductor at either end of the substrate engaging the plurality of resistors;

a dielectric layer formed over the plurality of resistors and electrical conductors; and a pair of laterally spaced-apart features formed over the first outer surface, disposed inwardly from ends of the electrical conductors and extending beyond an outermost surface of the heater element relative to the substrate, the features being disposed laterally outwardly relative to a center section of the substrate provided between said features, said features and center section being adapted to face an inner surface of the belt.

2. A heater element as set out in claim 1, wherein a portion of said dielectric layer defining a portion of each of said features.

3. A heater element as set out in claim 1, wherein said features comprise one or more layers of material provided only in areas corresponding to said features for defining portions of said features.

4. A heater element as set out in claim 1, wherein each of said features includes a plurality of layers, at least one of the layers comprising material used to define one of the resistors and the dielectric layer.

5. An apparatus for fixing a toner image on a substrate comprising:

a heater assembly comprising a heater element;

a flexible belt positioned about said heater assembly and including an inner surface engageable with said heater element so as to receive energy in the form of heat generated by said heater element;

a backup member positioned in opposition to said heater assembly, said flexible belt extending between said heater assembly and said backup member such that a fusing nip for receiving a substrate is defined between said backup member and said flexible belt at a location where said belt passes below a center portion of said heater element; and said heater element comprising laterally spaced-apart features extending above a center section of said heating element provided between said features and positioned upstream of said fusing nip, said features and center section of said heater element facing said belt inner surface, said backup member and said belt at locations where said belt passes said features engage laterally spaced apart outer edge portions of the substrate prior to said substrate entering said fusing nip to create laterally spaced-apart low pressure contact areas between a belt and the backup member.

6. An apparatus as set out in claim 5, wherein said features are positioned near a substrate input edge of said heater element.

7. An apparatus as set out in claim 5, wherein said heater element further comprises:

a substrate having first and second outer surfaces;

material provided on said substrate first outer surface, a first portion of said material provided on said substrate first outer surface defining elements capable of generating heat; and one or more glass layers provided over said material and at least one section of said substrate first outer surface not including said material.

8. An apparatus as set out in claim 7, wherein a portion of each of said one or more glass layers defining a portion of each of said features.

9. An apparatus as set out in claim 7, wherein said material further comprises second portions provided on said substrate first outer surface for defining portions of said features.

10. An apparatus as set out in claim 7, further comprising one or more additional layers of material provided only in areas corresponding to said features for defining portions of said features.

11. An apparatus as set out in claim 7, wherein an outermost glass layer defines an outer surface of said heater element engaging the inner surface of said belt, a portion of said outermost glass layer defining a layer of said center section provided between said features.

12. The heater element of claim 1, wherein each of the features includes layers of material used in forming the resistors and dielectric layer.

13. The heater element of claim 1, wherein the dielectric layer comprises a glass layer.

* * * * *